US011355875B2

(12) United States Patent
Wang et al.

(10) Patent No.: US 11,355,875 B2
(45) Date of Patent: Jun. 7, 2022

(54) DUAL-ROW CABLE STRUCTURE

(71) Applicant: ADVANCED-CONNECTEK INC., New Taipei (TW)

(72) Inventors: Wen-Yu Wang, New Taipei (TW); Ji-Zhou Li, New Taipei (TW); Ming-Yung Chang, New Taipei (TW); Tzu-Hao Li, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 17/033,009

(22) Filed: Sep. 25, 2020

(65) Prior Publication Data

US 2021/0091491 A1 Mar. 25, 2021

(30) Foreign Application Priority Data

Sep. 25, 2019 (CN) ..... 201910910623.5

(51) Int. Cl.

| | |
|---|---|
| ***H01R 12/71*** | (2011.01) |
| ***H01R 24/60*** | (2011.01) |
| *H01R 13/658* | (2011.01) |
| *H01R 107/00* | (2006.01) |

(52) U.S. Cl.

CPC ..... *H01R 12/716* (2013.01); *H01R 24/60* (2013.01); *H01R 13/658* (2013.01); *H01R 2107/00* (2013.01)

(58) Field of Classification Search

CPC ..... H01R 12/716; H01R 24/60; H01R 13/658

USPC ..... 439/65

See application file for complete search history.

(56) References Cited

U.S. PATENT DOCUMENTS

| | | | | |
|---|---|---|---|---|
| 5,046,966 | A * | 9/1991 | Snyder | H01R 24/50 439/579 |
| 6,687,775 | B1 * | 2/2004 | Bassett | G06F 3/0607 710/62 |
| 7,189,098 | B1 * | 3/2007 | Wu | H01R 13/405 439/352 |
| 7,232,329 | B1 * | 6/2007 | Wu | H01R 12/62 439/358 |
| 7,865,629 | B1 * | 1/2011 | Tantos | G06F 13/4068 710/11 |
| 8,512,071 | B2 * | 8/2013 | Tseng | H01R 13/6658 439/493 |

(Continued)

*Primary Examiner* — Alexander Gilman

(74) *Attorney, Agent, or Firm* — Muncy, Geissler, Olds & Lowe, P.C.

(57) ABSTRACT

A dual-row cable structure is applied to a first circuit board and a second circuit board. A board-to-board connector is on the first circuit board, and the first circuit board includes a first group of contacts and a second group of contacts. An electrical connector is on the second circuit board. The second circuit board includes a third group of contacts and a fourth group of contacts. The dual-row cable structure includes a wire assembly including high-speed signal wires, low-speed signal wires, one or more power wires, and one or more ground wires. The high-speed signal wires are connected to the first group of contacts. The low-speed signal wires, the power wire, and the ground wire are respectively connected to the second group of contacts. The third group of contacts and the fourth group of contacts are respectively connected to the other end of the wire assembly.

10 Claims, 17 Drawing Sheets

(56) References Cited

U.S. PATENT DOCUMENTS 8,719,112 B2 * 5/2014 Carpenter ..... G06Q 30/0601 705/26.63
9,033,744 B2 * 5/2015 Chen ..... H01R 12/721 439/660
9,077,124 B2 * 7/2015 Chen ..... H01R 12/721
9,373,903 B2 * 6/2016 Chang ..... H01R 12/594
9,607,738 B1 * 3/2017 Wu ..... H01B 11/20
9,674,964 B2 * 6/2017 Russell ..... H05K 3/32
9,979,145 B2 * 5/2018 Wu ..... H05K 1/111
9,990,320 B2 * 6/2018 Cheng ..... H01R 13/6589
10,211,571 B2 * 2/2019 Khorrami ..... H01R 12/737
10,490,959 B2 * 11/2019 Huang ..... H01R 24/62
10,817,453 B2 * 10/2020 Abdul-Razzak .... G06F 13/4068
11,088,481 B2 * 8/2021 Castiglione ..... H01R 12/61
2005/0130490 A1 * 6/2005 Rose ..... H01R 13/512 439/483
2006/0019525 A1 * 1/2006 Lloyd ..... G02B 6/4277 439/352
2007/0155217 A1 * 7/2007 Wu ..... H01R 13/512 439/353
2007/0155218 A1 * 7/2007 Wu ..... H01R 13/65915 439/358
2008/0067637 A1 * 3/2008 Voutilainen ..... H05K 1/0243 257/664
2009/0120668 A1 * 5/2009 Fjelstad ..... H01R 12/7082 174/250
2009/0197438 A1 * 8/2009 Liu ..... H01R 13/65914 439/76.1
2011/0083889 A1 * 4/2011 Niitsu ..... H05K 1/119 174/258
2012/0094519 A1 * 4/2012 Ikari ..... H01R 13/62933 439/297
2012/0184126 A1 * 7/2012 Chen ..... H01R 13/504 439/345
2016/0104971 A1 * 4/2016 Kurachi ..... H01R 13/652 439/147
2018/0269607 A1 * 9/2018 Wu ..... H01R 13/6275
2019/0081422 A1 * 3/2019 Chuang ..... H01R 24/60
2021/0091491 A1 * 3/2021 Wang ..... H01R 12/725
2021/0288426 A1 * 9/2021 Wang ..... H01R 12/596

* cited by examiner

DUAL-ROW CABLE STRUCTURE

CROSS-REFERENCE TO RELATED APPLICATION

This non-provisional application claims priority under 35 U.S.C. § 119(a) to Patent Application No. 201910910623.5 filed in China, P.R.C. on Sep. 25, 2019, the entire contents of which are hereby incorporated by reference.

FIELD OF THE INVENTION

The instant disclosure relates to a cable structure, and more particular to a dual-row cable structure.

BACKGROUND

Consumer electronics tend to become smaller, thinner, and lighter. The electrical connection between the circuit boards with wires is a common configuration in the consumer electronics. Hence, the layout of the first circuit board can be extended through the wires, so that the internal space of the consumer electronics can be properly arranged. For an electronic device (e.g., a notebook computer), the size of the electronic device is small, and the electronic device has a relatively limited internal space. Therefore, the circuit boards are electrically connected with each other through wires or board-to-board electrical connector(s), so that the electronic device can have better space utilization.

In general, the wires are arranged into a one-row flat cable structure, and the flat cable structure has thirty data wires. Further, in order to meet the USB signal transmission interface, the flat cable structure has several power wires, several ground wires, four pairs of high-speed signal wires, and a pair of low-speed signal wires, etc.

The pitch assignment of the thirty data wires in the one-row flat cable structure is shown as the following table.

| Position | 1 | 2 | 3 | 4 | 5 | 6 | 7 | 8 | 9 | 10 |
|---|---|---|---|---|---|---|---|---|---|---|
| Definition | Vbus | Vbus | Vbus | GND | TX1 | TX1 | GND | RX1 | RX1 | GND |
| Position | 11 | 12 | 13 | 14 | 15 | 16 | 17 | 18 | 19 | 20 |
| Definition | CC | GND | SUB2 | GND | D+ | D− | GND | SUB1 | GND | CC2 |
| Position | 21 | 22 | 23 | 24 | 25 | 26 | 27 | 28 | 29 | 30 |
| Definition | GND | TX2 | TX2 | GND | RX2 | RX2 | GND | Vbus | Vbus | Vbus |

In the flat cable structure, since two ground wires are respectively arranged at two sides of each pair of the high-speed differential signal wires, two sides of the pair of the low-speed differential signal wires, two sides of each of the common mode auxiliary data signal wires, two sides of each of the common mode auxiliary control signal wires, and two sides of each of the E-MAK chip power supply voltage signal wires, the flat cable structure has a larger width and has following problems.

The first problem is the larger width and space needed by the flat cable structure. In detail, the flat cable structure has too many data wires so as to have a higher cost and larger welded area as well as larger width of the printed circuit board (PCB). As a result, the flat cable structure does not meet the thin-and-short design trend for the nowadays consumer electronic products.

The second problem is the difficulties in processing the flat cable structure. The signal wires and the power wires are assembled as the one-row flat cable structure; however, the signal wires and the power wires have different structures and have to be cut or pealed with different processes. Moreover, for these wires, the materials of the insulation layers and the sizes of the core wires are different, thereby making the difficulties in the pealing and welding processes. Furthermore, the defect rate and the processing time for the product may be increased.

The third problem is the interference between the high-speed signals. In the flat cable structure, the adjacent high-speed signal pairs are just spaced by one ground wire. As a result, the signals of the adjacent high-speed signal pairs may be interfered with each other to cause improper cross-talk (for example, in the case that the flat cable structure has 42 AWG wires, the distance between adjacent wires may be too close).

The fourth problem is the electromagnetic interference (EMI)/radiofrequency interference (RFI) issue. The welding regions of the flat cable structure for the type-C connector and for another plug connector are just covered with UV glues, and the welding regions are not shielded with any metallic shell. As a result, when the flat cable structure is used for high-speed signal transmissions, EMI/RFI problems may occur easily.

SUMMARY OF THE INVENTION

One embodiment of the instant disclosure provides a dual-row cable structure. The dual-row cable structure is applied to a first circuit board and a second circuit board. A board-to-board connector is on the first circuit board. The first circuit board comprises a first group of contacts and a second group of contacts. An electrical connector is on the second circuit board. The second circuit board comprises a third group of contacts and a fourth group of contacts. The dual-row cable structure comprises a wire assembly comprising a plurality of high-speed signal wires, a plurality of low-speed signal wires, at least one power wire, and at least one ground wire. One of two ends of each of the high-speed signal wires of the wire assembly is connected to the first group of contacts. One of two ends of each of the low-speed signal wires of the wire assembly is connected to the second group of contacts. One of two ends of the at least one power wire of the wire assembly and one of two ends of the at least one ground wire of the wire assembly are respectively connected to the second group of contacts. The third group of contacts and the fourth group of contacts are respectively connected to the other end of the wire assembly.

In one or some embodiments, the first group of contacts and the second group of contacts are on an upper surface of the first circuit board, or on a lower surface of the first circuit board, or respectively on the upper surface and the lower surface of the first circuit board.

In one or some embodiments, the board-to-board connector comprises an insulated housing and a plurality of terminals at the insulated housing. The board-to-board connector is a receptacle connector or a plug connector.

In one or some embodiments, the dual-row cable structure further comprises a first outer cover on the first circuit board to cover the high-speed signal wires.

In one or some embodiments, the dual-row cable structure further comprises a second outer cover on the second circuit board to cover the high-speed signal wires.

In one or some embodiments, the third group of contacts and the fourth group of contacts are on an upper surface of the second circuit board, or on a lower surface of the second circuit board, or respectively on the upper surface and the lower surface of the second circuit board.

In one or some embodiments, the electrical connector is another board-to-board connector, and the another board-to-board connector comprises an insulated housing and a plurality of terminals at the insulated housing. The another board-to-board connector is a receptacle connector or a plug connector.

In one or some embodiments, the electrical connector is a USB type-C connector, and the USB type-C connector comprises an insulated housing, a plurality of terminals at the insulated housing, and a metallic shell enclosing the insulated housing.

In one or some embodiments, the third group of contacts is connected to the high-speed signal wires, and the fourth group of contacts is connected to the low-speed signal wires, the at least one power wire, and the at least one ground wire.

In one or some embodiments, the dual-row cable structure further comprises a metallic covering member covering the wire assembly.

In one or some embodiments, the wire assembly is a cable or two flat cables aligned side by side.

According to one or some embodiments of the instant disclosure, ground wires are not provided between the high-speed signal wires. Moreover, the flat cable is formed by two rows of the wire assembly aligned side by side, so that the width of the flat cable is narrower. Furthermore, the wire assembly is flexible such that the wire assembly can be freely bent in a horizontal plane, so that the dual-row cable structure can be applied in the layout of the thin-and-light type notebooks.

According to one or some embodiments of the instant disclosure, the dual-row cable structure has following advantages.

One of the advantages is the width and space needed by the dual-row cable structure is reduced to half of that needed by a flat cable structure known to the inventor. Since the dual-row cable structure adopts the wires in the dual-row configuration, the width of the wire assembly in the structure can be reduced to half of the overall widths of the wires in the wire assembly. Moreover, since the dual-row cable structure adopts the dual-row board-to-board connector, the width of the connector can be also reduced. Therefore, in the structure, reduced welded area and reduced width of the printed circuit board can be configured. Hence, the cost for the structure can be reduced and the structure meets the thin-and-short design trend for the nowadays consumer electronic products.

One of the advantages is that the processing of the structure is easier. In the structure, the high-speed signal wires (which use coaxial wires or signal paired wires with shielding functions) are separated from the power wires and the low-speed signal wires (which use electronic wires, paired wires, or twisted paired wires) to be two rows of cables or wiring harnesses. The high-speed signal wires have the same wire diameter, while the power wires and the low-speed signal wires have similar wire diameters. The wires are processed in two times, thereby greatly reducing the difficulties in processing the wires as well as reducing the processing time and the defect rate of the wires.

One of the advantages is that the interference between high-speed signals is reduced. As mentioned, the structure has a reduced width such that a larger space can be provided for the welded area. Therefore, the spacing between each pair of the high-sped signal wires can be increased. Hence, not only the interference between signals can be reduced, but also ground wires are not necessarily to be provided between the signal wires, thus reducing the material usage for the wires as well as the cost for the structure.

One of the advantages is that the EMI/RFI issues can be improved. By applying the metallic covering member covering the board-to-board plug connector and the USB type-C plug connector, the welded area can be shielded. Moreover, a shielding member comprising metal material such as conductive fabric, copper foil, or aluminum foil, can be applied out the wire assembly to improve the EMI/RFI issues effectively when the structure is used to transmit high-speed signals.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
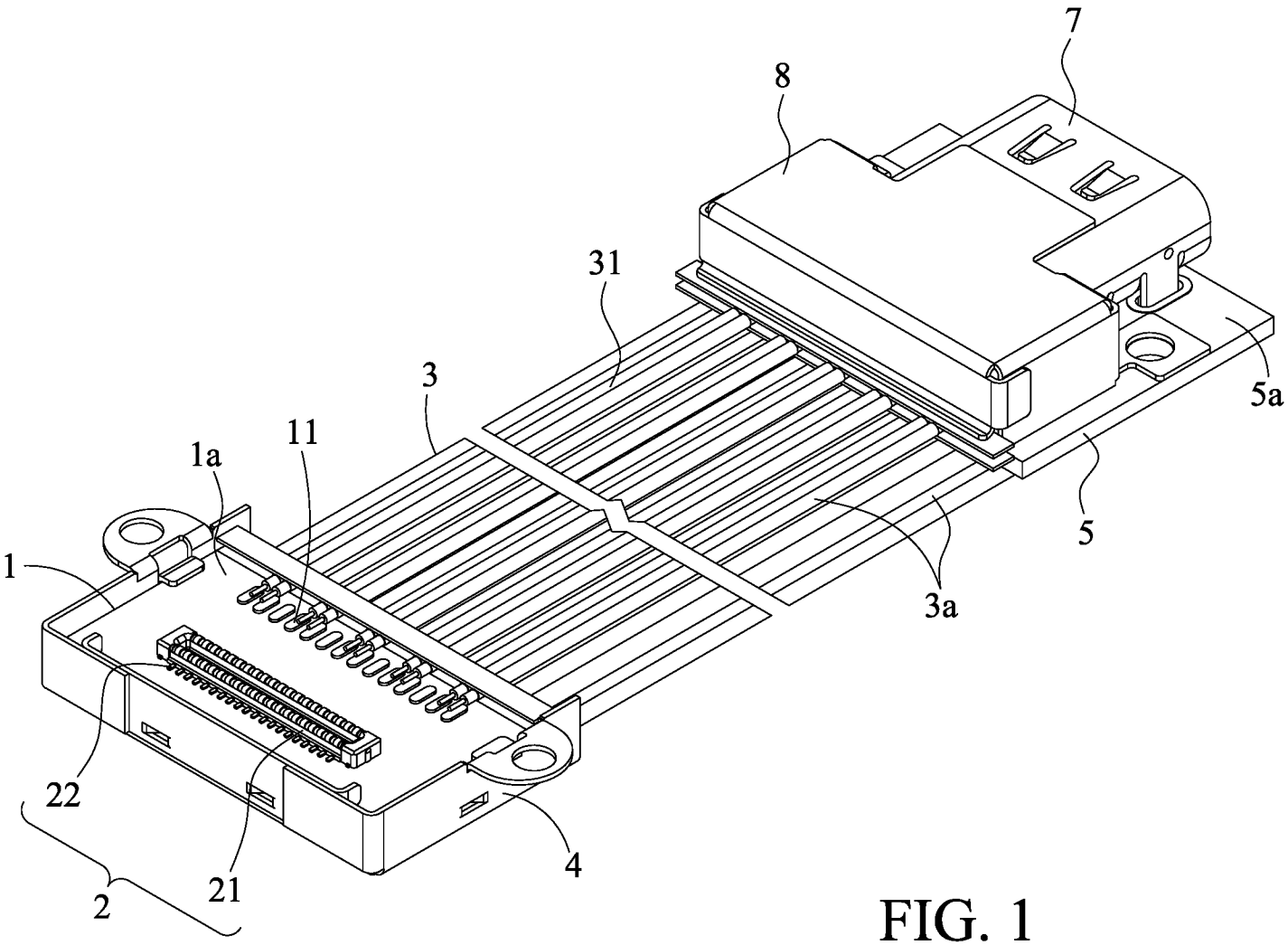
FIG. 1 illustrates a perspective view of a dual-row cable structure according to a first embodiment of the instant disclosure.
Figure 2:
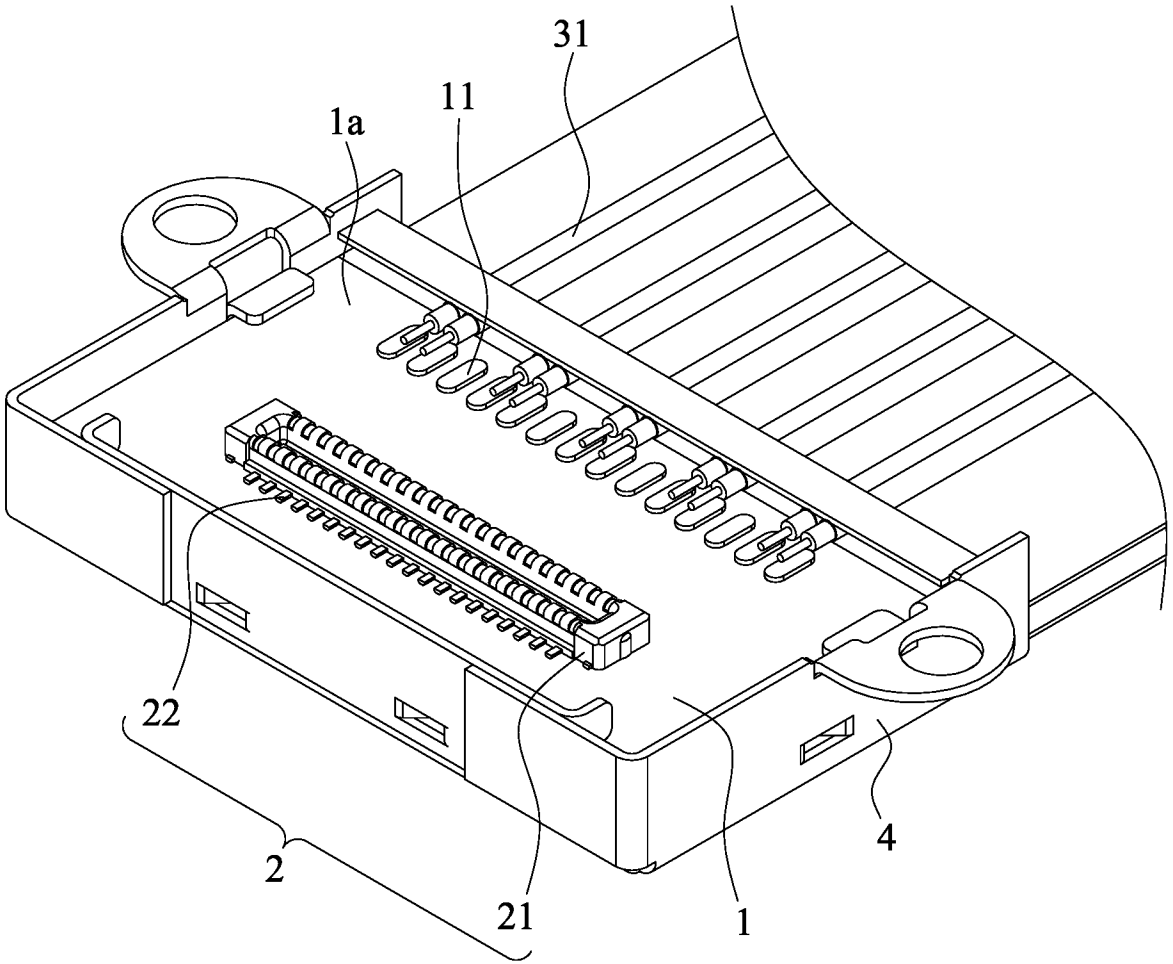
FIG. 2 illustrates a perspective view of a first circuit board of the dual-row cable structure of the first embodiment.
Figure 3:
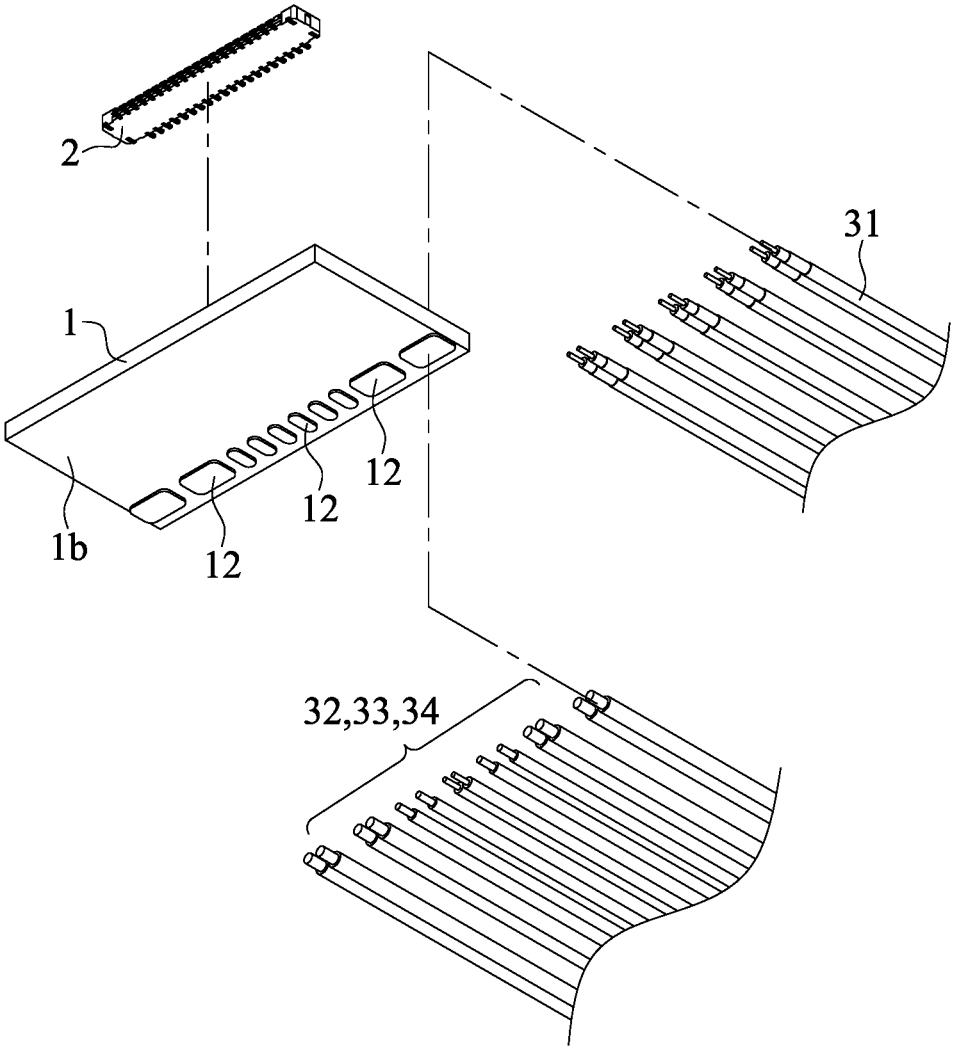
FIG. 3 illustrates a partial exploded view showing the first circuit board, a board-to-board connector, and a wire assembly of the dual-row cable structure of the first embodiment.
Figure 4:
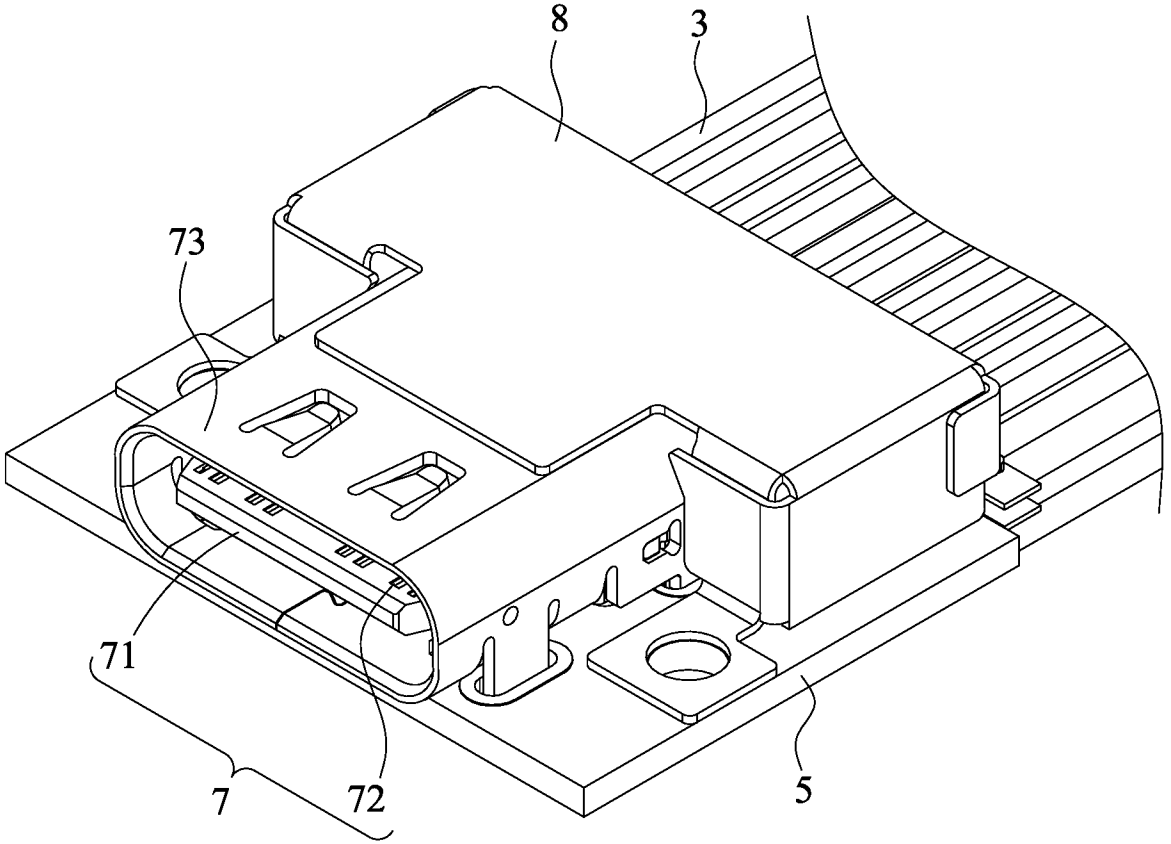
FIG. 4 illustrates a perspective view of a second circuit board of the dual-row cable structure of the first embodiment.
Figure 5:
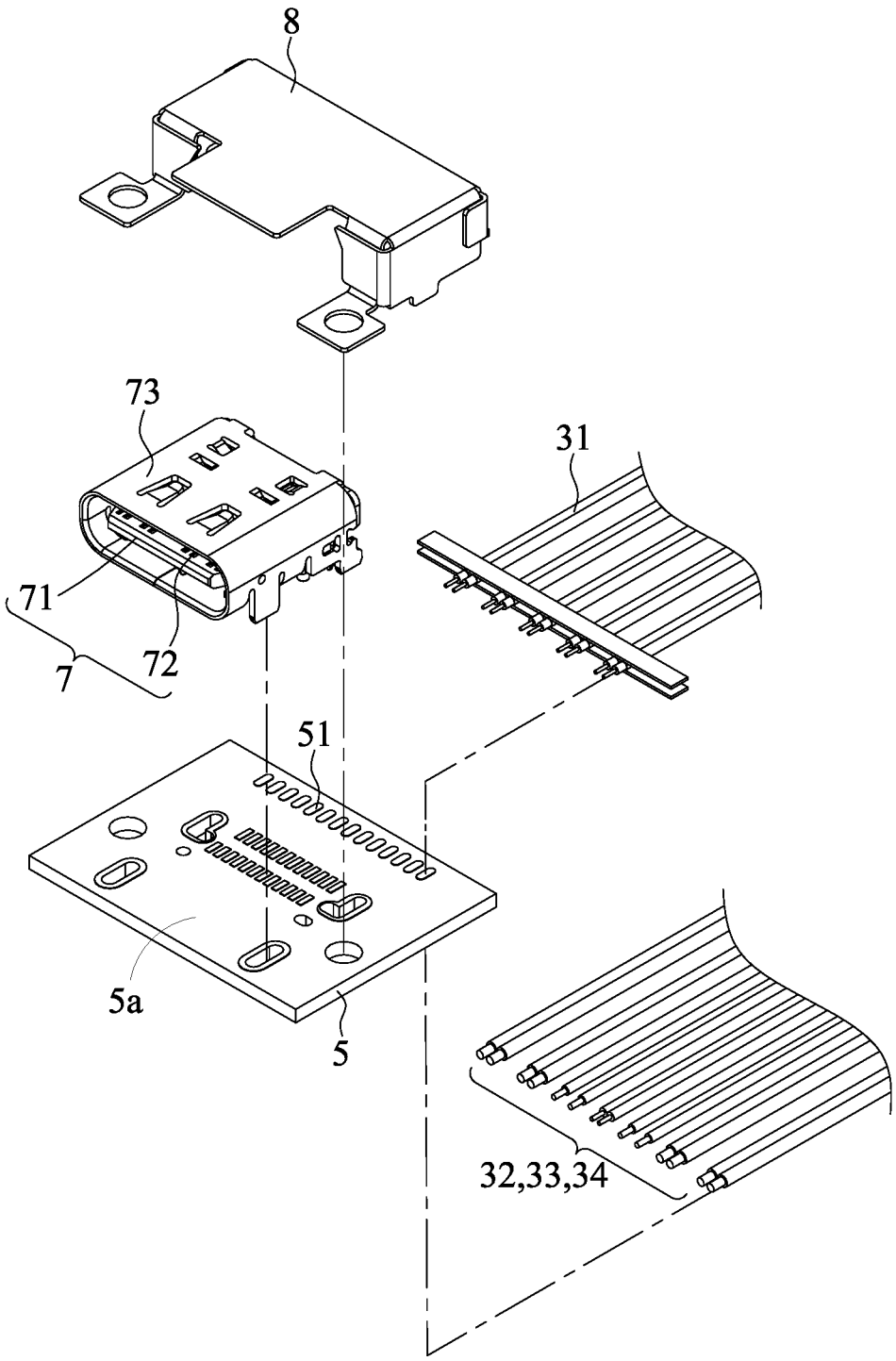
FIG. 5 illustrates a partial front exploded view showing the second circuit board, a USB type-C connector, and the wire assembly of the dual-row cable structure of the first embodiment.
Figure 6:
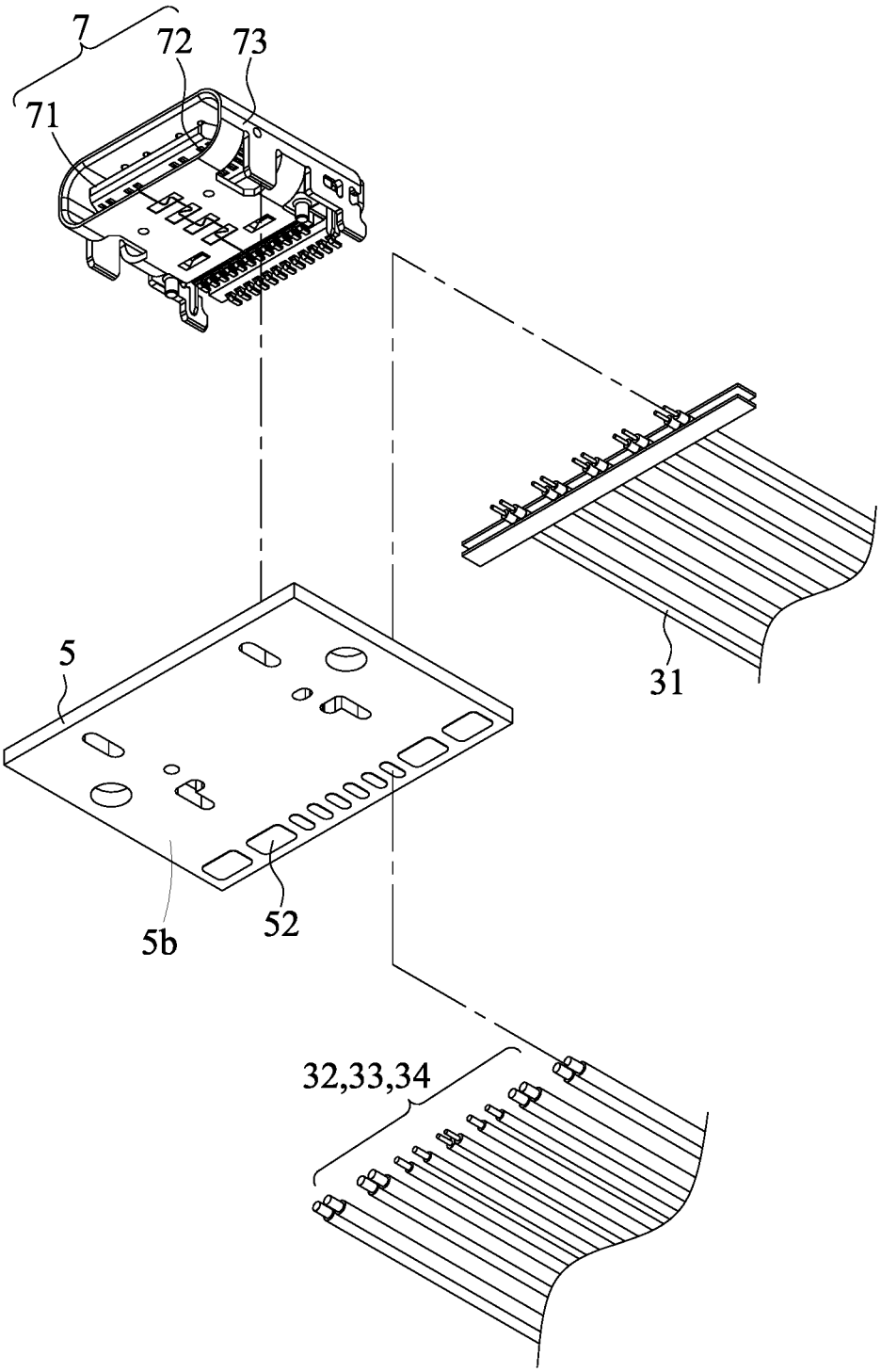
FIG. 6 illustrates a partial back exploded view showing the second circuit board, the USB-type C connector, and the wire assembly of the dual-row cable structure of the first embodiment.

Please refer to FIGS. 1 to 6. A dual-row cable structure according to a first embodiment of the instant disclosure is illustrated. FIG. 1 illustrates a perspective view of a dual-row cable structure according to the first embodiment. FIG. 2 illustrates a perspective view of a first circuit board 1 of the dual-row cable structure of the first embodiment. FIG. 3 illustrates a partial exploded view showing the first circuit board 1, a board-to-board connector 2, and a wire assembly 3 of the dual-row cable structure of the first embodiment. FIG. 4 illustrates a perspective view of a second circuit board 5 of the dual-row cable structure of the first embodiment. FIG. 5 illustrates a partial front exploded view showing the second circuit board 5, a USB type-C connector 7, and the wire assembly 3 of the dual-row cable structure of the first embodiment. FIG. 6 illustrates a partial back exploded view showing the second circuit board 5, the USB-type C connector 7, and the wire assembly 3 of the dual-row cable structure of the first embodiment. In this embodiment, the dual-row cable structure is applied to a first circuit board 1 and a second circuit board 5, and the dual-row cable structure comprises a wire assembly 3.

In this embodiment, the board-to-board connector 2 is on the first circuit board 1, and the first circuit board 1 comprises a first group of contacts 11 and a second group of contacts 12.

In this embodiment, the wire assembly 3 comprises a plurality of high-speed signal wires 31, a plurality of low-speed signal wires 32, at least one power wire 33, and at least one ground wire 34.

In this embodiment, one of two ends of each of the high-speed signal wires 31 of the wire assembly 3 is connected to the first group of contacts 11, one of two ends of each of the low-speed signal wires 32 of the wire assembly 3 is connected to the second group of contacts 12, and one of two ends of the at least one power wire 33 and one of two ends of the at least one ground wire 34 of the wire assembly 3 are respectively connected to the second group of contacts 12.

In this embodiment, an electrical connector is on the second circuit board 5. The second circuit board 5 comprises a third group of contacts 51 and a fourth group of contacts 52. The third group of contacts 51 and the fourth group of contacts 52 are respectively connected to the other end of the wire assembly 3.

In this embodiment, more specifically, the high-speed signal wires 31 use coaxial wires or signal paired wires with shielding functions. Conversely, the low-speed signal wires 32, the at least one power wire 33, and the at least one ground wire 34 use electronic wires, paired wires, or twisted paired wires.

Figure 12:
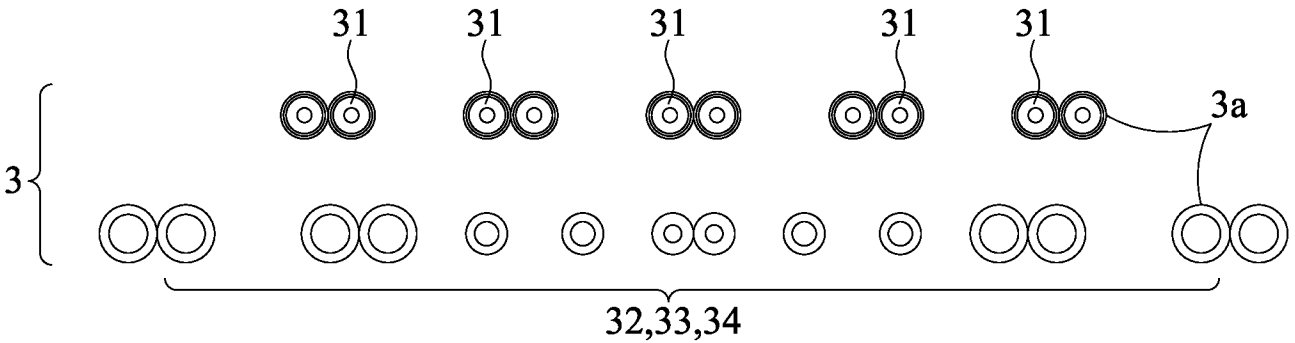
FIG. 12 illustrates a front view of the wire assembly of the dual-row cable structure of the first embodiment.

As shown in FIG. 12, the wire assembly 3 is configured as two flat cables 3*b* aligned side by side, and is divided into two rows of cables or wiring harnesses. An implementation for the wire assembly 3 is that the first row of the wire assembly 3 is the high-speed signal wires 31, and the second row of the wire assembly 3 is the low-speed signal wires 32, the at least one power wire 33, and the at least one ground wire 34. Alternatively, in one or some embodiments, the first row of the wire assembly 3 may be low-speed signal wires 32.

In this embodiment, more specifically, the first group of contacts 11 and the second group of contacts 12 are respectively on an upper surface 1*a* and a lower surface 1*b* of the first circuit board 1, but embodiments are not limited thereto. In one or some embodiments, the first group of contacts 11 and the second group of contacts 12 may both on the upper surface 1*a* of the first circuit board 1 or both on the lower surface 1*b* of the first circuit board 1.

Figure 7:
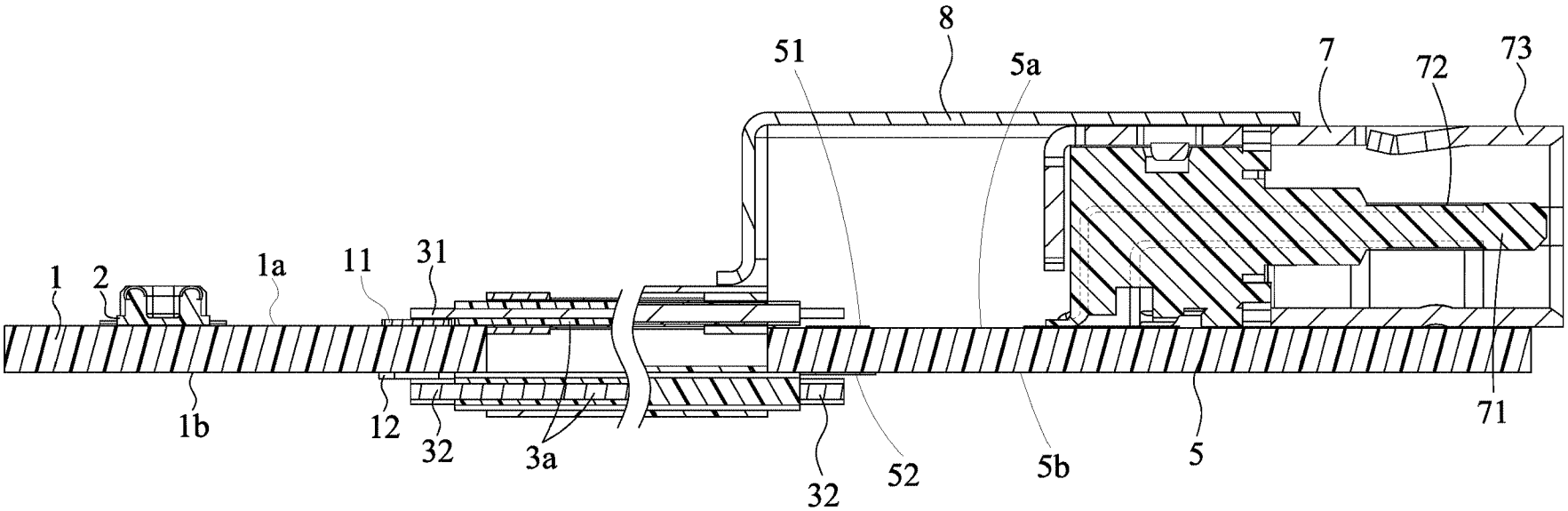
FIG. 7 illustrates a side cross-sectional view of the dual-row cable structure of the first embodiment.
Figure 13:
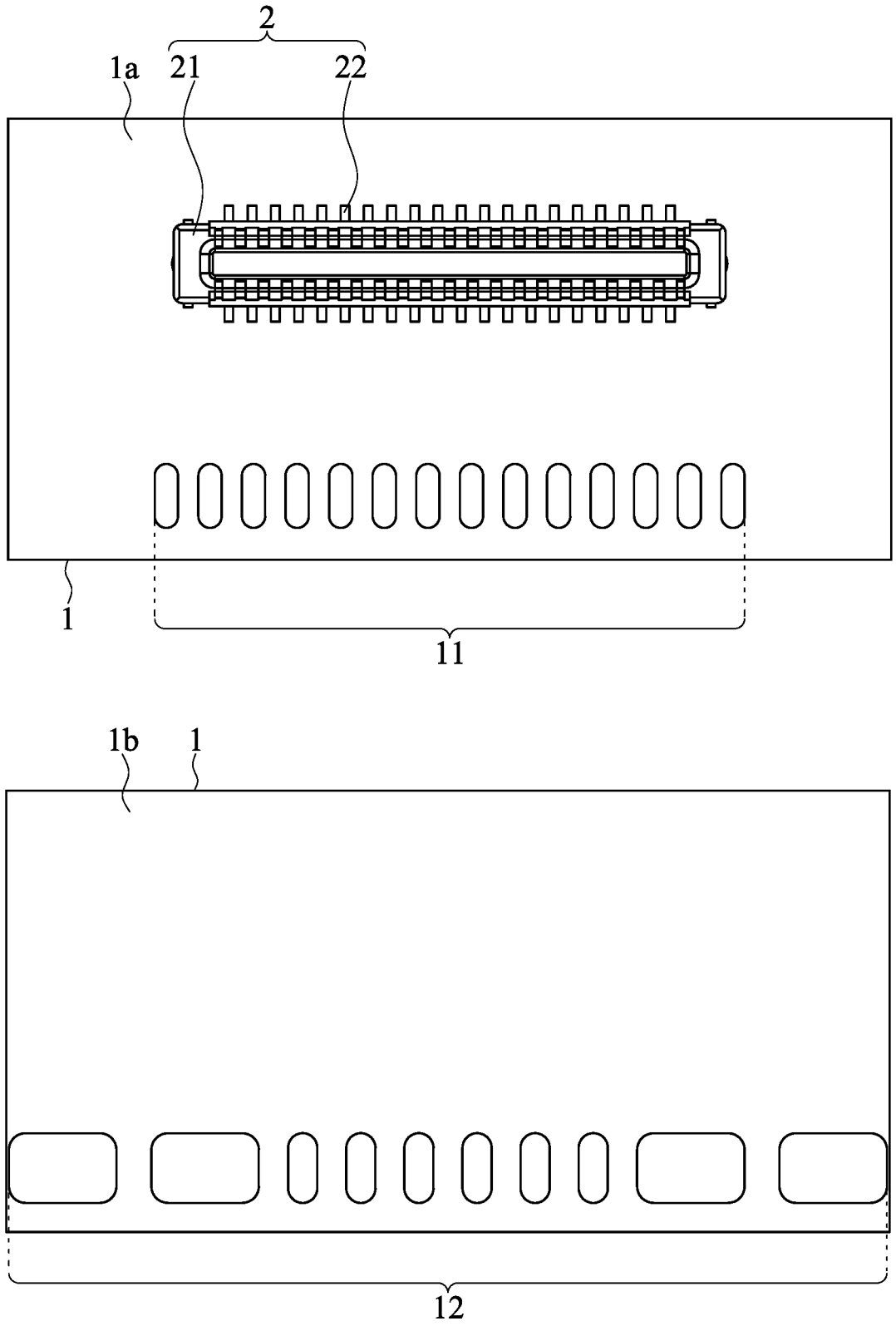
FIG. 13 illustrates top and bottom views of the first circuit board of the dual-row cable structure of the first embodiment.

As shown in FIGS. 7 and 13, the first group of contacts 11 may be on the upper surface 1*a* of the first circuit board 1, the second group of contacts 12 may be on the lower surface 1*b* of the first circuit board 1, and the board-to-board connector 2 may be on the upper surface 1*a* of the first circuit board 1.

Figure 8:
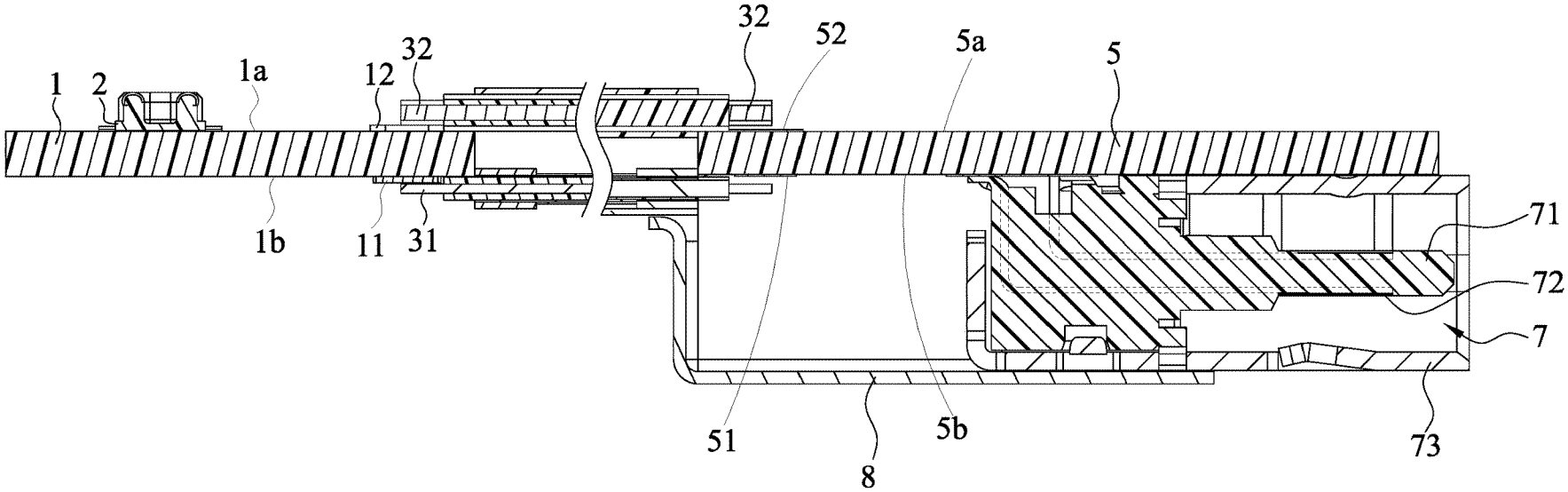
FIG. 8 illustrates a side cross-sectional view (1) of the dual-row cable structure of the first embodiment, in another implementation.
Figure 14:
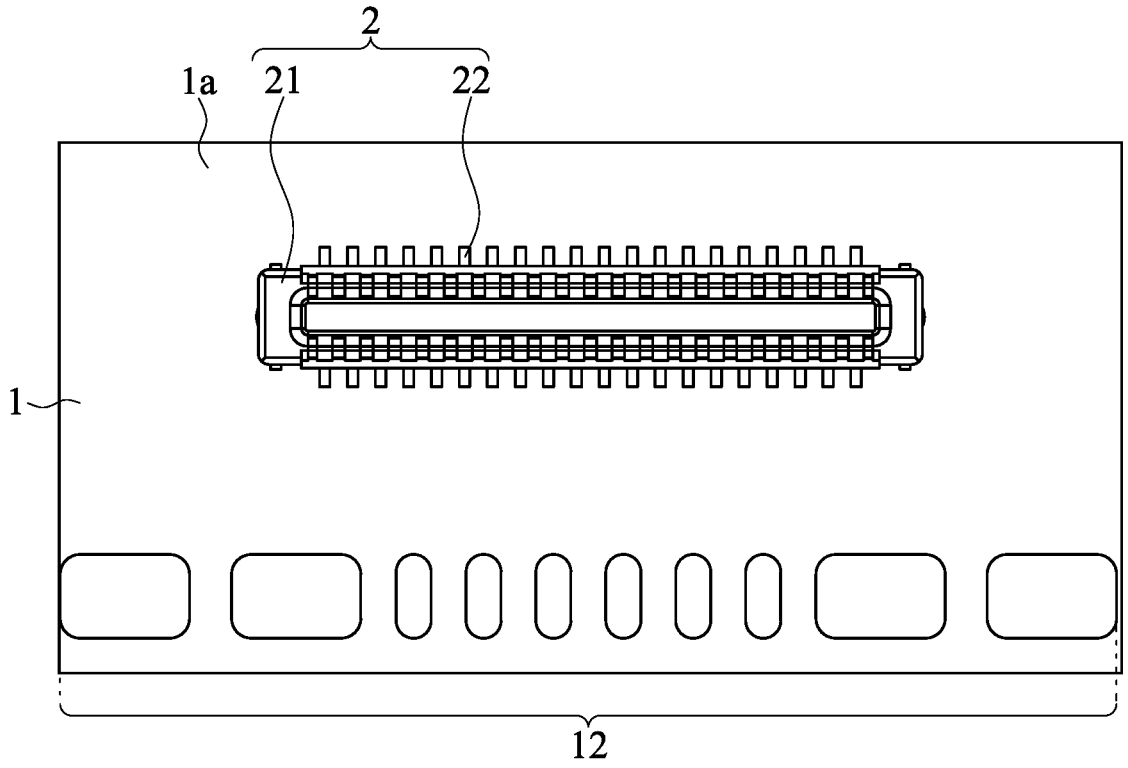
FIG. 14 illustrates top and bottom views of the first circuit board of the dual-row cable structure of the first embodiment, in another implementation.
Figure 14:
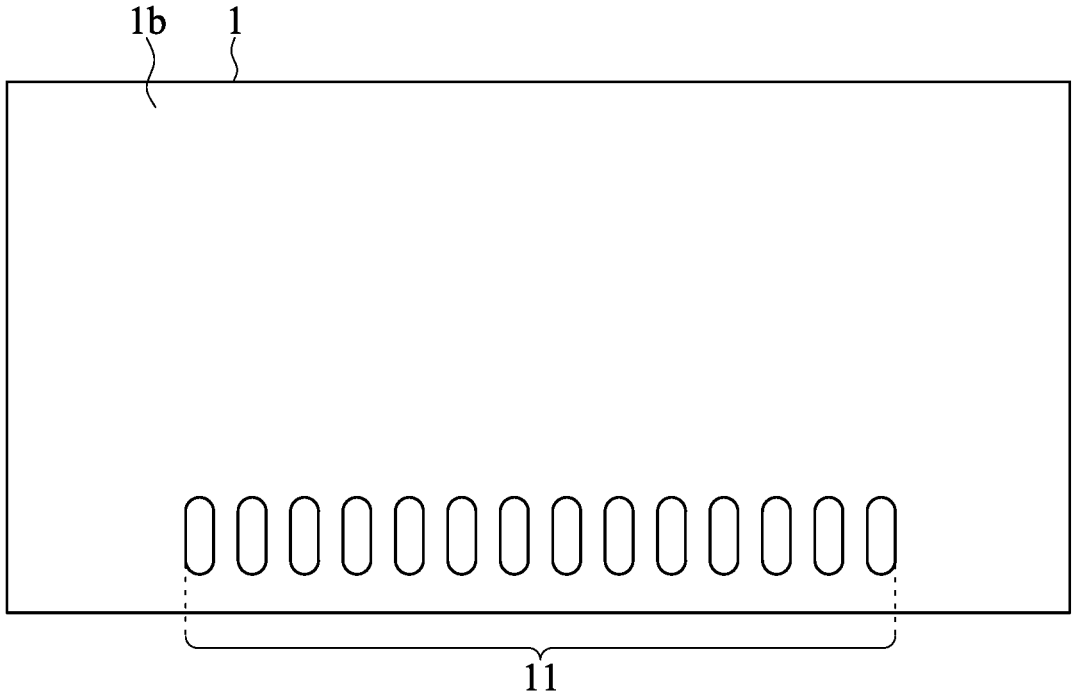

As shown in FIGS. 8 and 14, the first group of contacts 11 may be on the lower surface 1*b* of the first circuit board 1, the second group of contacts 12 may be on the upper surface 1*a* of the first circuit board 1, and the board-to-board connector 2 may be on the upper surface 1*a* of the first circuit board 1.

Figure 9:
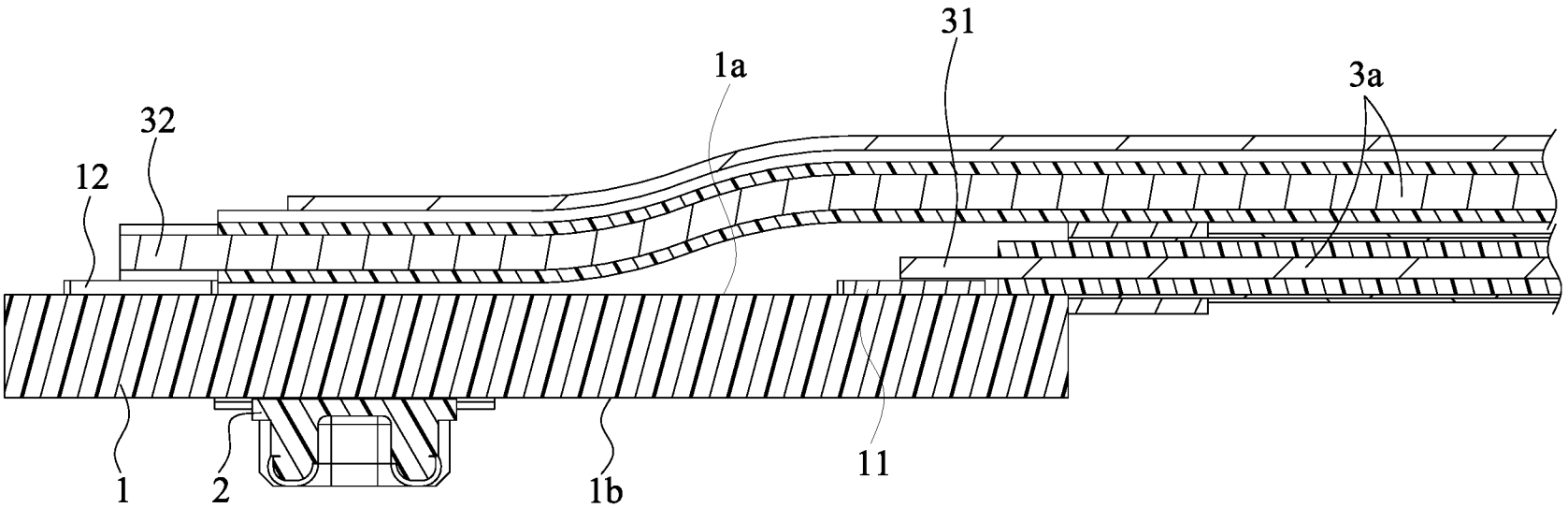
FIG. 9 illustrates a side cross-sectional view (2) of the dual-row cable structure of the first embodiment, in another implementation.

As shown in FIG. 9, the first group of contacts 11 may be on the upper surface 1*a* of the first circuit board 1, and the second group of contacts 12 may also be on the upper surface 1*a* of the first circuit board 1. In this embodiment, the first group of contacts 11 and the second group of contacts 12 are on different positions of the same surface of the first circuit board 1. The board-to-board connector 2 may be on the upper surface 1*a* or the lower surface 1*b* of the first circuit board 1.

In this embodiment, more specifically, the board-to-board connector 2 comprises an insulated housing 21 and a plurality of terminals 22 at the insulated housing 21. The board-to-board connector 2 may be a plug connector or a receptacle connector. The terminals 22 are provided for signal transmission, and the transmission current of the terminals 22 is in a range between 0.3 A to 0.5 A.

Figure 10:
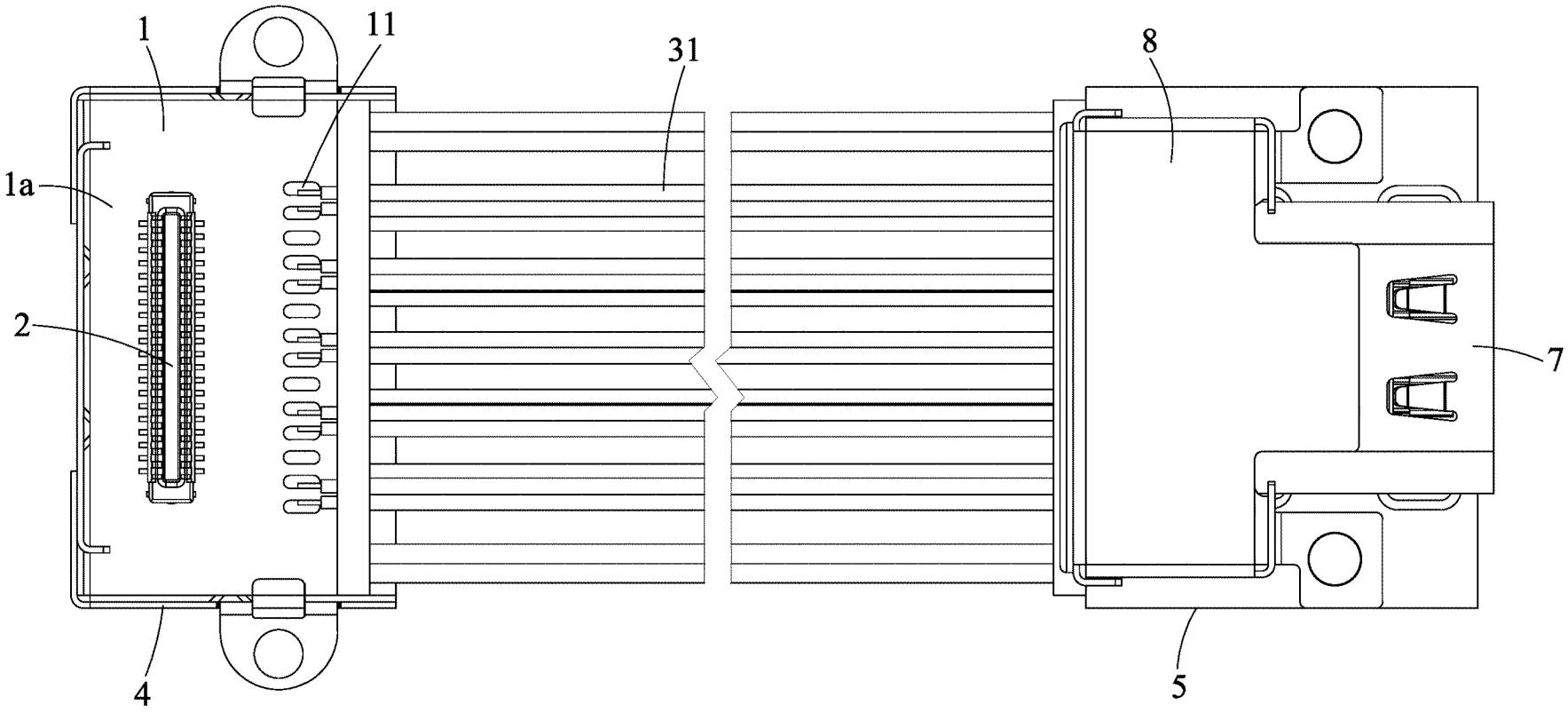
FIG. 10 illustrates a top view of the dual-row cable structure of the first embodiment.

As shown in FIG. 10, in this embodiment, more specifically, the electrical connector on the second circuit board 5 is a USB type-C connector 7, and the USB type-C connector 7 comprises an insulated housing 71, a plurality of terminals 72 at the insulated housing 71, and a metallic shell 73 enclosing the insulated housing 71. In this embodiment, the USB type-C connector 7 is a receptacle connector. In this embodiment, the third group of contacts 51 is connected to the high-speed signal wires 31, and the fourth group of contacts 52 is connected to the low-speed signal wires 32, the at least one power wire 33, and the at least one ground wire 34, as shown in FIGS. 5 and 6.

Figure 11:
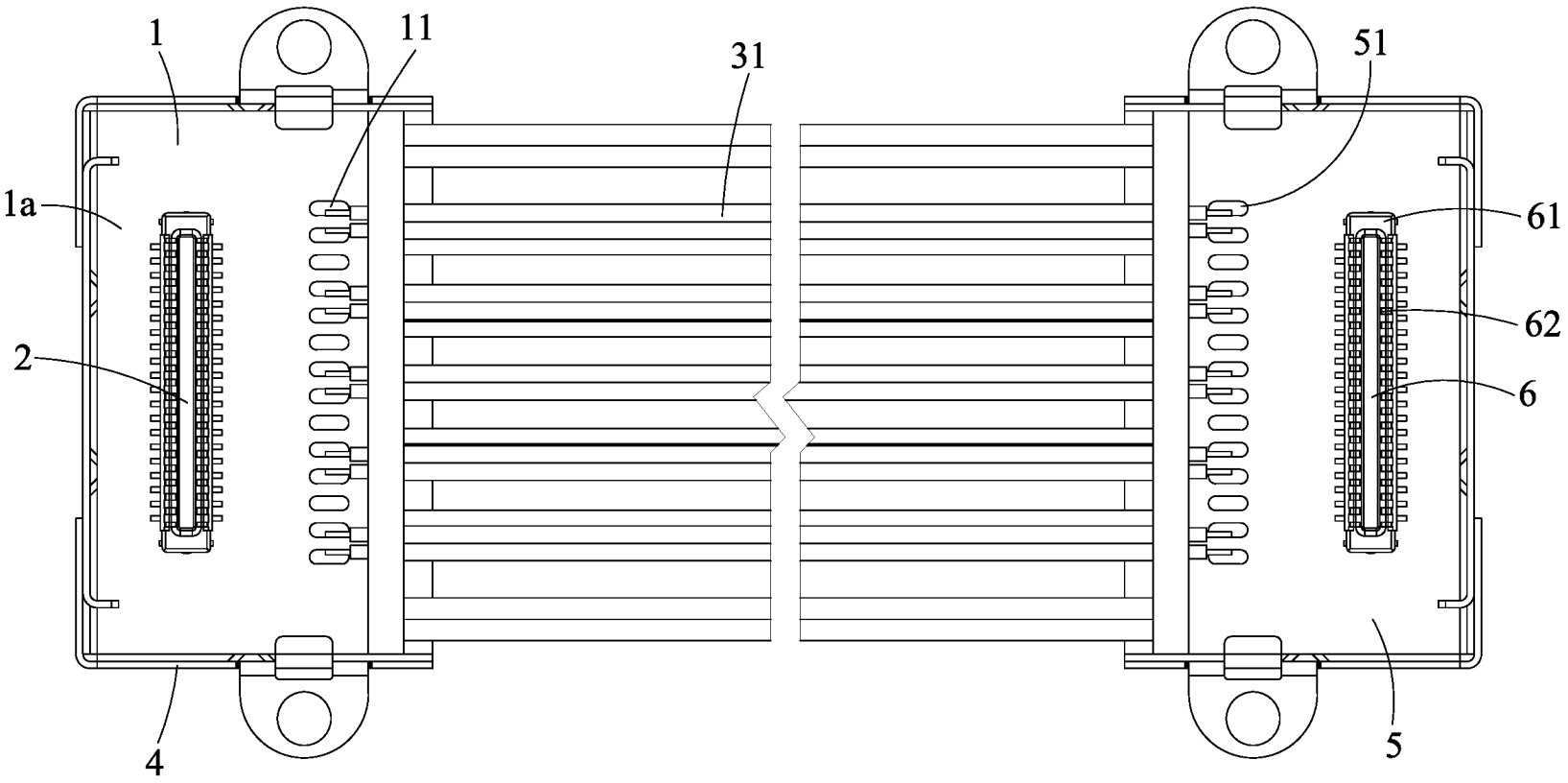
FIG. 11 illustrates a top view of the dual-row cable structure of the first embodiment, in another implementation.

As shown in FIG. 11, in this embodiment, more specifically, the electrical connector may be a board-to-board connector 6. The board-to-board connector 6 comprises an insulated housing 61 and a plurality of terminals 62 at the insulated housing 61. The board-to-board connector 6 may be a plug connector or a receptacle connector. The terminals 62 are provided for signal transmission, and the transmission current of the terminals 62 is in a range between 0.3 A to 0.5 A. In this embodiment, the third group of contacts 51 is connected to the high-speed signal wires 31, and the fourth group of contacts 52 is connected to the low-speed signal wires 32, the at least one power wire 33, and the at least one ground wire 34 (not shown).

As shown in FIG. 1, in this embodiment, more specifically, the dual-row cable structure further comprises a first outer cover 4 (a metallic cover) on the first circuit board 1 to cover the high-speed signal wires 31. Therefore, when the high-speed signal wires 31 are used to transmit high-speed signals, the electromagnetic interference (EMI) and the radiofrequency interference (RFI) issues can be improved.

As shown in FIG. 1, in this embodiment, more specifically, the dual-row cable structure further comprises a second outer cover 8 (a metallic cover) on the second circuit board 5 to cover the high-speed signal wires 31. Therefore, when the high-speed signal wires 31 are used to transmit high-speed signals, the electromagnetic interference (EMI) and the radiofrequency interference (RFI) issues can be improved.

In this embodiment, more specifically, the third group of contacts 51 and the fourth group of contacts 52 are respectively on an upper surface 5*a* and a lower surface 5*b* of the second circuit board 5, but embodiments are not limited thereto. In one or some embodiments, the third group of contacts 51 and the fourth group of contacts 52 may both on the upper surface 5*a* of the second circuit board 5 or both on the lower surface 5*b* of the second circuit board 5.

Figure 15:
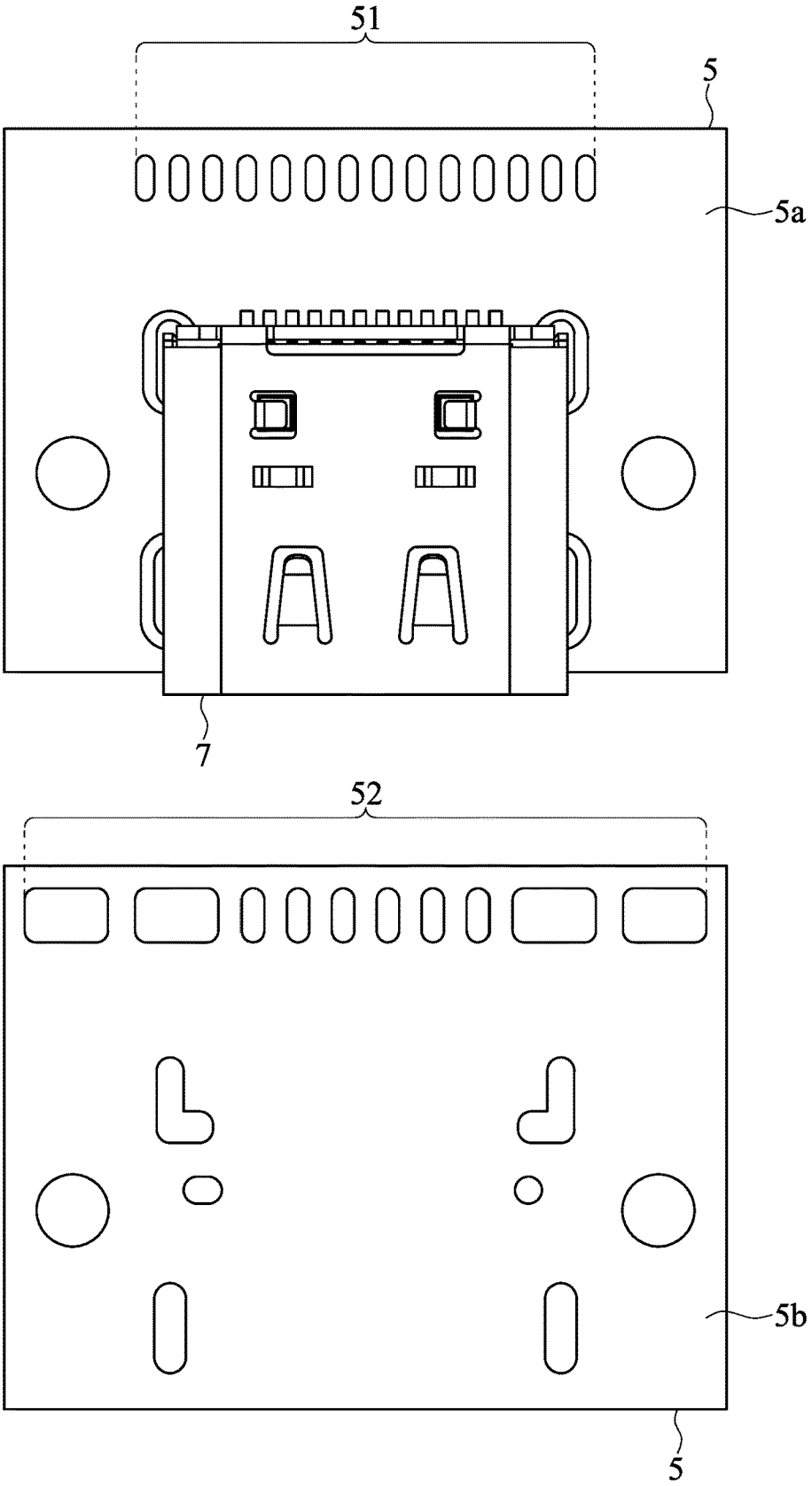
FIG. 15 illustrates top and bottom views of the second circuit board of the dual-row cable structure of the first embodiment.

As shown in FIGS. 7 and 15, the third group of contacts 51 may be on the upper surface 5*a* of the second circuit board 5, the fourth group of contacts 52 may be on the lower surface 5*b* of the second circuit board 5, and the USB type-C connector 7 may be on the upper surface 5*a* of the second circuit board 5.

As shown in FIG. 8, the third group of contacts 51 may be on the lower surface 5*b* of the second circuit board 5, the fourth group of contacts 52 may be on the upper surface 5*a* of the second circuit board 5, and the USB type-C connector 7 may be on the lower surface 5*b* of the second circuit board 5.

Moreover, the third group of contacts 51 may be on the upper surface 5*a* of the second circuit board 5, and the fourth group of contacts 52 may also be on the upper surface 5*a* of the second circuit board 5. In this embodiment, the third group of contacts 51 and the fourth group of contacts 52 are on different positions of the same surface of the second circuit board 5 (not shown).

Figure 16:
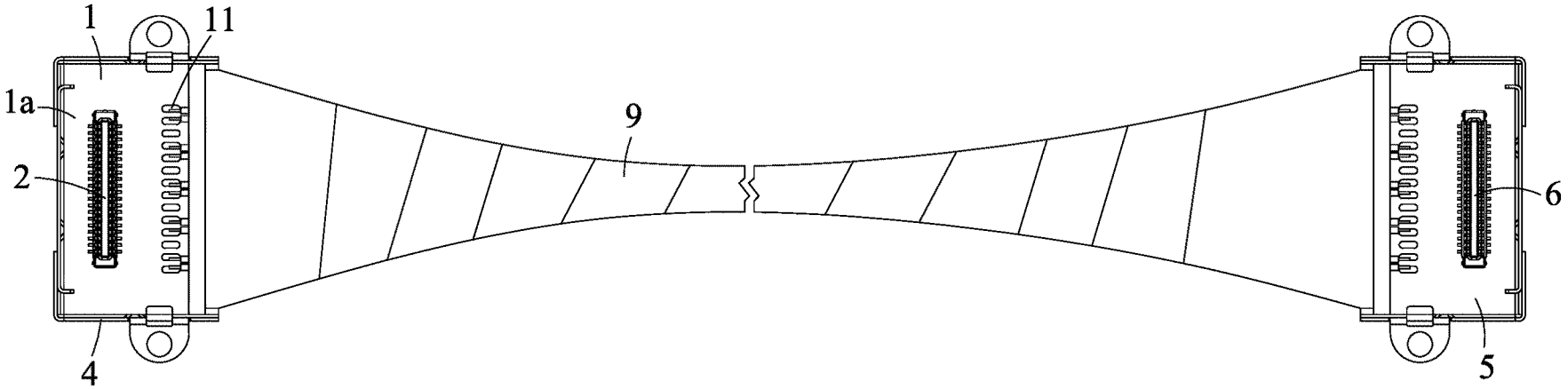
FIG. 16 illustrates a top view showing that the wire assembly is covered with a metallic covering member.

Please refer to FIG. 16. FIG. 16 illustrates a top view showing that the wire assembly 3 is covered with a metallic covering member 9. In this embodiment, the dual-row cable structure further comprises a metallic covering member 9 covering the wire assembly 3.

By covering the metallic covering member 9 (which is a shielding member comprising metal material such as conductive fabric, copper foil, or aluminum foil) out of the wire assembly 3, the EMI/RFI issues can be improved effectively when the structure is used to transmit high-speed signals.

Figure 17:
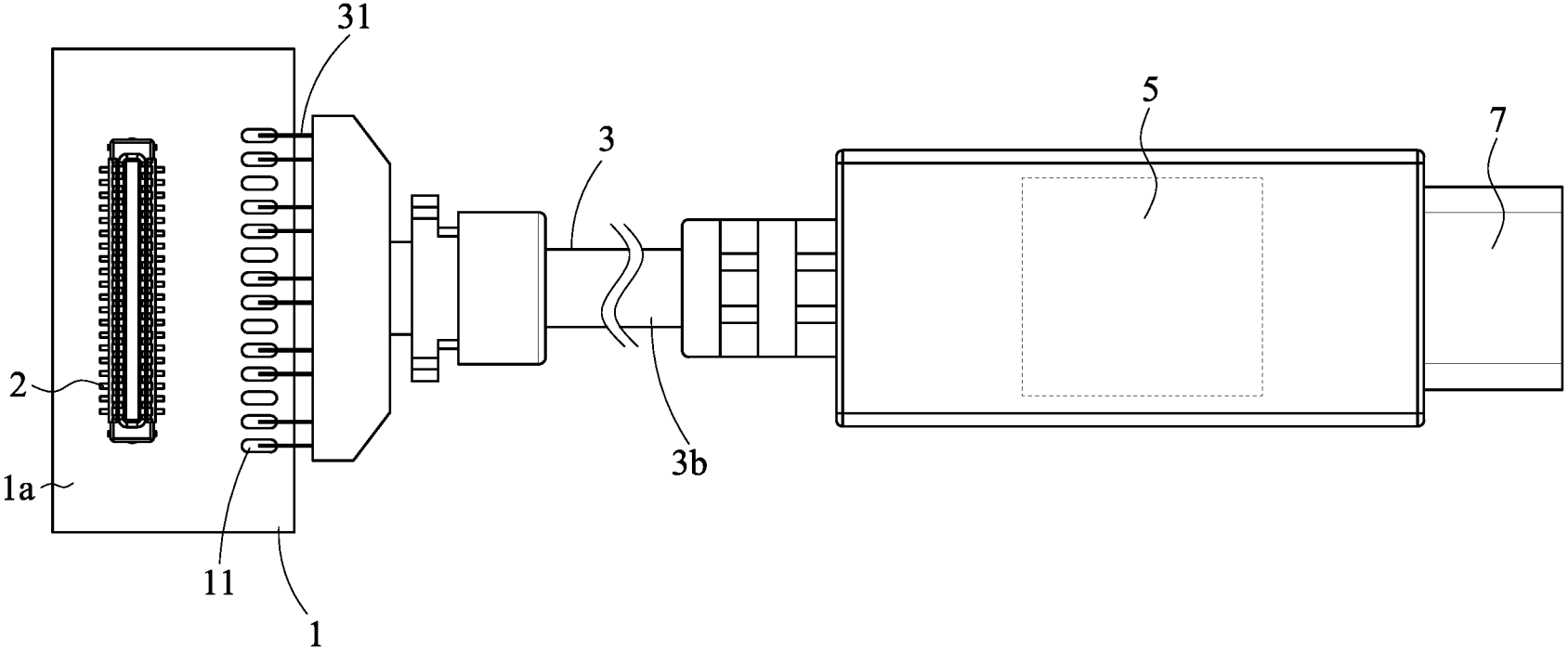
FIG. 17 illustrates a top view of a dual-row cable structure according to a second embodiment of the instant disclosure.

Please refer to FIG. 17. A dual-row cable structure according to a second embodiment of the instant disclosure is illustrated. FIG. 17 illustrates a top view of the dual-row cable structure according to the second embodiment. In this second embodiment, the wire assembly 3 is a cable 3*b*, and the wire assembly 3 is the wire extending from the rear portion of the USB type-C connector 7. In this embodiment, the USB type-C connector 7 is a plug connector, and the USB type-C connector 7 is connected to the second circuit board 5. The end portion of the cable 3*b* extends to connect to a plurality of high-speed signal wires 31 for being welded with the first group of contacts 11 on the first circuit board 1, and the end portion of the cable 3*b* extends to connect to a plurality of low-speed signal wires 32, at least one power wire 33, and at least one ground wire 34 for being welded with the second group of contacts 12 on the first circuit board 1 (not shown).

According to one or some embodiments of the instant disclosure, ground wires are not provided between the high-speed signal wires. Moreover, the flat cable is formed by two rows of the wire assembly aligned side by side, so that the width of the flat cable is narrower. Furthermore, the wire assembly is flexible such that the wire assembly can be freely bent in a horizontal plane, so that the dual-row cable structure can be applied in the layout of the thin-and-light type notebooks.

The flexible flat cable (FFC) or the flexible printed circuit (FPC) known to the inventor cannot be bent easily and have worse flexibilities. The FFC or FPC cannot be bent freely in a horizontal plane, thereby having lower applicability for thin-and-short consumer electronics.

According to one or some embodiments of the instant disclosure, the dual-row cable structure has following advantages.

One of the advantages is the width and space needed by the dual-row cable structure is reduced to half of that needed by a flat cable structure known to the inventor. Since the dual-row cable structure adopts the cables in the dual-row configuration, the width of the wire assembly in the structure can be reduced to half of the overall widths of the wires in the wire assembly. Moreover, since the dual-row cable structure adopts the dual-row board-to-board connector, the width of the connector can be also reduced. Therefore, in the structure, reduced welded area and reduced width of the printed circuit board can be configured. Hence, the cost for the structure can be reduced and the structure meets the thin-and-short design trend for the nowadays consumer electronic products.

One of the advantages is that the processing of the structure is easier. In the structure, the high-speed signal wires (which use coaxial wires or signal paired wires with shielding functions) are separated from the power wires and the low-speed signal wires (which use electronic wires, paired wires, or twisted paired wires) to be two rows of cables or wiring harnesses. The high-speed signal wires have the same wire diameter, while the power wires and the low-speed signal wires have similar wire diameters. The wires are processed in two times, thereby greatly reducing the difficulties in processing the wires as well as reducing the processing time and the defect rate of the wires.

One of the advantages is that the interference between high-speed signals is reduced. As mentioned, the structure has a reduced width such that a larger space can be provided for the welded area. Therefore, the spacing between each pair of the high-sped signal wires can be increased. Hence, not only the interference between signals can be reduced, but also ground wires are not necessarily to be provided between the signal wires, thus reducing the material usage for the wires as well as the cost for the structure.

One of the advantages is that the EMI/RFI issues can be improved. By applying the metallic covering member covering the board-to-board plug connector and the USB type-C plug connector, the welded area can be shielded. Moreover, a shielding member comprising metal material such as conductive fabric, copper foil, or aluminum foil, can be applied out the wire assembly to improve the EMI/RFI issues effectively when the structure is used to transmit high-speed signals.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A dual-row cable structure applied to a first circuit board and a second circuit board, wherein a board-to-board connector is on the first circuit board, the first circuit board comprises a first group of contacts and a second group of contacts, an electrical connector is on the second circuit board, the second circuit board comprises a third group of contacts and a fourth group of contacts, wherein the dual-row cable structure comprises:

a wire assembly, comprising:

a plurality of high-speed signal wires, wherein one of two ends of each of the high-speed signal wires of the wire assembly is connected to the first group of contacts;

a plurality of low-speed signal wires, wherein one of two ends of each of the low-speed signal wires of the wire assembly is connected to the second group of contacts;

at least one power wire, wherein one of two ends of the at least one power wire of the wire assembly is connected to the second group of contacts; and at least one ground wire, wherein one of two ends of the at least one ground wire of the wire assembly is connected to the second group of contacts, wherein the third group of contacts and the fourth group of contacts are respectively connected to the other end of the wire assembly, and wherein the first group of contacts and the second group of contacts are on an upper surface of the first circuit board, or on a lower surface of the first circuit board, or respectively on the upper surface and the lower surface of the first circuit board.

2. The dual-row cable structure according to claim 1, wherein the board-to-board connector comprises an insulated housing and a plurality of terminals at the insulated housing, the board-to-board electrical connector is a receptacle connector or a plug connector.

3. The dual-row cable structure according to claim 1, further comprising a first outer cover on the first circuit board to cover the high-speed signal wires.

4. The dual-row cable structure according to claim 1, further comprising a second outer cover on the second circuit board to cover the high-speed signal wires.

5. The dual-row cable structure according to claim 1, further comprising a metallic covering member covering the wire assembly.

6. The dual-row cable structure according to claim 1, wherein the wire assembly is a cable or two flat cables aligned side by side.

7. A dual-row cable structure applied to a first circuit board and a second circuit board, wherein a board-to-board connector is on the first circuit board, the first circuit board comprises a first group of contacts and a second group of contacts, an electrical connector is on the second circuit board, the second circuit board comprises a third group of contacts and a fourth group of contacts, wherein the dual-row cable structure comprises:

a wire assembly, comprising:

a plurality of high-speed signal wires, wherein one of two ends of each of the high-speed signal wires of the wire assembly is connected to the first group of contacts;

a plurality of low-speed signal wires, wherein one of two ends of each of the low-speed signal wires of the wire assembly is connected to the second group of contacts;

at least one power wire, wherein one of two ends of the at least one power wire of the wire assembly is connected to the second group of contacts; and at least one ground wire, wherein one of two ends of the at least one ground wire of the wire assembly is connected to the second group of contacts, wherein the third group of contacts and the fourth group of contacts are respectively connected to the other end of the wire assembly, wherein the first group of contacts and the second group of contacts are on an upper surface of the first circuit board, or on a lower surface of the first circuit board, or respectively on the upper surface and the lower surface of the first circuit board, and wherein the third group of contacts and the fourth group of contacts are on an upper surface of the second circuit board, or on a lower surface of the second circuit board, or respectively on the upper surface and the lower surface of the second circuit board.

8. The dual-row cable structure according to claim 7, wherein the electrical connector is another board-to-board connector, the another board-to-board connector comprises an insulated housing and a plurality of terminals at the insulated housing, the another board-to-board connector is a receptacle connector or a plug connector.

9. The dual-row cable structure according to claim 8, wherein the third group of contacts is connected to the high-speed signal wires, and the fourth group of contacts is connected to the low-speed signal wires, the at least one power wire, and the at least one ground wire.

10. A dual-row cable structure applied to a first circuit board and a second circuit board, wherein a board-to-board connector is on the first circuit board, the first circuit board comprises a first group of contacts and a second group of contacts, an electrical connector is on the second circuit board, the second circuit board comprises a third group of contacts and a fourth group of contacts, wherein the dual-row cable structure comprises:

a wire assembly, comprising:

a plurality of high-speed signal wires, wherein one of two ends of each of the high-speed signal wires of the wire assembly is connected to the first group of contacts;

a plurality of low-speed signal wires, wherein one of two ends of each of the low-speed signal wires of the wire assembly is connected to the second group of contacts;

at least one power wire, wherein one of two ends of the at least one power wire of the wire assembly is connected to the second group of contacts; and at least one ground wire, wherein one of two ends of the at least one ground wire of the wire assembly is connected to the second group of contacts, wherein the third group of contacts and the fourth group of contacts are respectively connected to the other end of the wire assembly, wherein the first group of contacts and the second group of contacts are on an upper surface of the first circuit board, or on a lower surface of the first circuit board, or respectively on the upper surface and the lower surface of the first circuit board, wherein the third group of contacts and the fourth group of contacts are on an upper surface of the second circuit board, or on a lower surface of the second circuit board, or respectively on the upper surface and the lower surface of the second circuit board, and wherein the electrical connector is a USB type-C connector, the USB type-C connector comprises an insulated housing, a plurality of terminals at the insulated housing, and a metallic shell enclosing the insulated housing.

* * * * *